US005393142A

United States Patent [19]

Meier

[11] Patent Number: 5,393,142

[45] Date of Patent: Feb. 28, 1995

[54] IMPELLER FOR STIRRING STERILE LIQUIDS

[75] Inventor: Hans P. Meier, Jona, Switzerland

[73] Assignee: Mavag Verfahrenstechnik AG, Altendorf, Switzerland

[21] Appl. No.: 129,582

[22] Filed: Sep. 30, 1993

[30] Foreign Application Priority Data

Oct. 1, 1992 [DE] Germany ..... 4232936

[51] Int. Cl.[6] ..... B01F 13/08

[52] U.S. Cl. ..... 366/274; 366/314

[58] Field of Search ..... 366/138, 169, 262–265, 366/273, 274, 314, 331; 415/116; 416/3, 93 R

[56] References Cited

U.S. PATENT DOCUMENTS

| | | | |
|---|---|---|---|
| 2,278,397 | 3/1942 | Scheibe et al. | 416/93 X |
| 4,209,259 | 6/1980 | Rains et al. | 366/273 |
| 4,649,118 | 3/1987 | Anderson | 366/274 X |
| 4,653,519 | 3/1987 | Kanner | 366/273 |
| 4,993,841 | 2/1991 | Löfgren et al. . | |

FOREIGN PATENT DOCUMENTS

| | | | |
|---|---|---|---|
| 0399972 | 11/1990 | European Pat. Off. . | |
| 3238647 | 5/1984 | Germany . | |
| 1130722 | 5/1989 | Japan | 366/273 |

*Primary Examiner*—David A. Scherbel
*Assistant Examiner*—Charles Cooley
*Attorney, Agent, or Firm*—Michael J. Striker

[57] ABSTRACT

An impeller for stirring sterile liquids has a plurality of stirring plates, an impeller head supporting the stirring plates and having an outer surface, a central hollow chamber with an opening, a conduit connecting the central hollow chamber with the outer surface, and a driving pin received in the opening. The impeller head has a lower region provided with a plurality of grooves which during rotation of the impeller head provide an effect of pumping the liquids.

13 Claims, 3 Drawing Sheets

FIG. 1
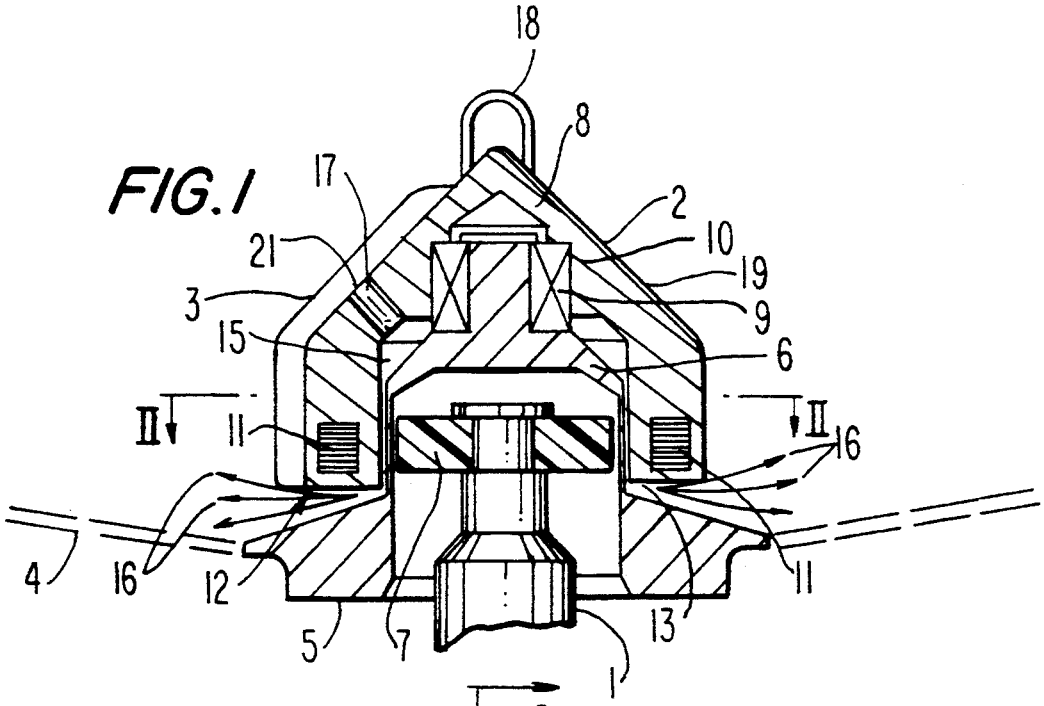
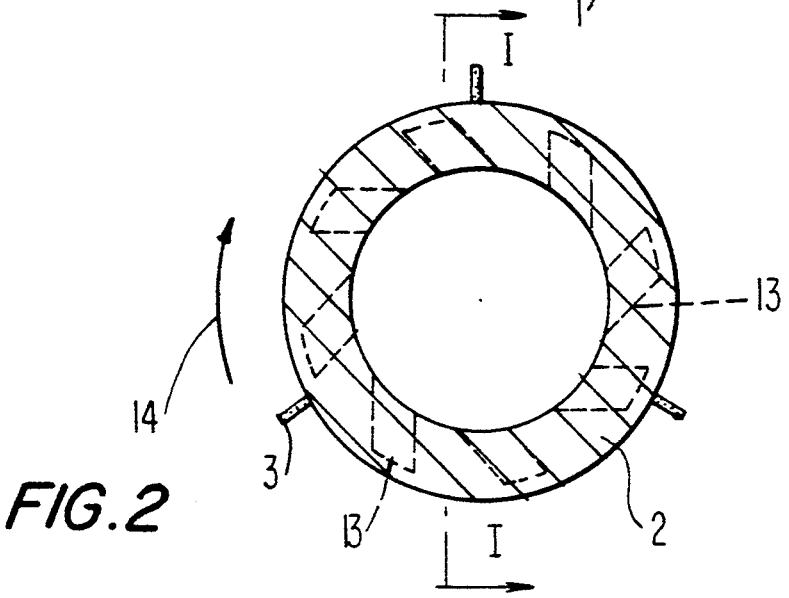
FIG. 2

IMPELLER FOR STIRRING STERILE LIQUIDS

BACKGROUND OF THE INVENTION

The present invention relates to an impeller for stirring sterile liquids.

More particularly, it relates to an impeller which has an impeller head with stirring plates and an opening arranged below for receiving a pin in a central hollow chamber, while the impeller is driven inductively or magnetically in a contactless manner and the central hollow chamber has at least one conduit connectable with the outer surface.

Such an impeller is disclosed for example in the U.S. Pat. No. 4,993,841 and the European patent document EP-A1 0 399 972. The impeller head has a plurality of radially outwardly extending stirring plates, the conduits open behind them as considered in the rotary direction on the outer surface, and the outer surface is connected with a central hollow chamber. Since during the operation, a negative pressure zone is formed behind the stirring plates, liquid is aspirated through these openings from the inner hollow chamber which is completed by the lower opening for receiving the drive pin. In this manner, during the operation, a stream flows through the inner hollow chamber of the impeller. During cleaning of the container with corresponding sterilizing liquids, it can also reach the interior of the impeller so that dead corners are avoided in which the process liquid can remain after withdrawal of the charge.

The above-described impeller has, however, the disadvantage that the self-cleaning effect does not act for low filling heights when the liquid no longer flows through the conduit connected with the highest opening of the hollow chamber with the outer surface, but instead is connected with the atmosphere. Due to the flow field which is formed during the operation, this condition occurs at the filling height where the fluid level in the static case completely covers the impeller.

SUMMARY OF THE INVENTION

Accordingly, it is an object of the present invention to provide an impeller whose self-cleaning function is also ensured at low filling heights.

In keeping with these objects and with others which will become apparent hereinafter, one feature of the present invention resides, briefly stated, in an impeller of the above-mentioned type in which the impeller head in the lower region, preferably its lower surface is formed as a rotor of a pump, in particular a slow pump. In accordance with the present invention the pumping effect is not determined by the position of the connecting conduit, but instead by the special design of the lower impeller end. The pumping effect is therefore obtained also at low filling heights. It is sufficient to form for example the lower surface as a flow pump or to arrange the turbine-vane-like wing laterally on the impeller.

In the inventive impeller, a rotary direction is provided which forms a positive pressure in a central hollow chamber. For this purpose a flow is formed which is directed from the deepest surface of the impeller into the central hollow chamber. The aspirated liquid flows outwardly from it to the connecting conduit and from the latter. The inner hollow chamber remains filled with fluid also when the connecting conduit opens in the atmosphere and the fluid does not flow around it. In accordance with a further embodiment of the present invention, the central hollow chamber and/or the pin is formed in the partial regions as a conical opening or a conical pin. The produced positive pressure provides an axial force on the impeller, which counteracts the conventional stirring forces in the axial direction. Thereby the resulting axial forces are partially compensated. Due to the conical design, the flow cross-section in the hollow chamber changes in dependence on the axial position of the impeller relative to the pin. In certain cases a support of the impeller on a liquid film is provided, which adjusts automatically and obtains an equilibrium position.

When the impeller has a rotary axis, in whose region on the surface the connecting conduit opens, the flow conditions at the opening of the connecting conduit no longer influence the volume flow through the impeller. The volume flow is thereby dependent only on the pumping effect of the lower surface of the impeller formed for pumping.

When for predetermined process liquids the volume stream must be additionally increased, then for supporting the pumping effect one or several connecting conduits are arranged so that they open in the rotary direction behind the stirring plates.

In accordance with another embodiment of the present invention, the impeller has a rotary direction which forms a negative pressure in the central hollow chamber.

Thereby the emptying of the sterile container is improved since in this rotary direction the central hollow chamber of the impeller is forcibly emptied.

During the operation, the volumes which flow through the impeller per time unit can be increased when one or several connecting conduits are arranged so that they open before the stirring plates.

In particular for low rotary speeds, it is advantageous when the lower region of the impeller is formed as a displacement pump. Thereby, for example, the central hollow chamber can have an eccentric opening section in the opening region, and the pin can carry an impeller rim composed of elastomeric material. In cooperation with correspondingly arranged inlet and outlet openings, the pump can operate as a known impeller pump.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing an axial section of an impeller in accordance with the present invention;

FIG. 2 is a view showing a horizontal section of the inventive impeller taken along the line II—II in FIG. 1;

DESCRIPTION OF PREFERRED EMBODIMENTS

Figure 3:
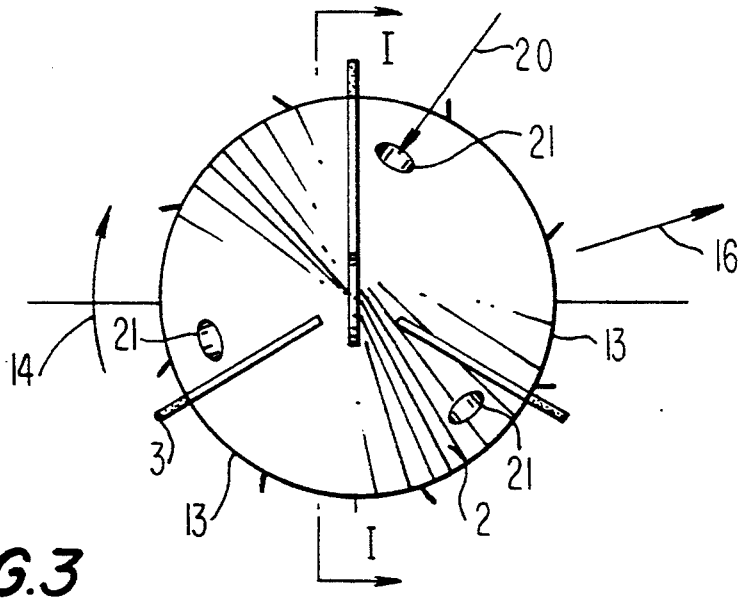
FIGS. 3 and 4 are views showing flow directions during driving in a clockwise direction.

In FIG. 1 a drive shaft of a drive unit which is not shown in great detail is identified with reference numeral 1. The drive unit drives an impeller head 2 provided with a plurality of stirring plates 3. The impeller head is arranged in the lower part of a container whose lower container wall 4 is illustrated in broken lines. A mounting flange 5 is welded in the wall and has a pin 6 extending into the interior of the container. The pin 6 is hollow. The drive shaft 1 extends into the hollow interior of the pin 6 and carries at its upper end a magnet disk 7 provided with several permanent magnets so as to be rotated by the drive shaft.

The mounting flange 5 is composed of a non-magnetic steel. The upper part of the pin 6 is formed as a cylindrical seating surface 8 of a bearing 9. The bearing 9 serves for rotatable fixation of the impeller head 2 with an inner seating surface 10. A number of oppositely polarized permanent magnets 11 are arranged in the interior of the impeller head 2 opposite to the magnet disk 7. Therefore due to the magnetic forces between the magnet disk 7 and permanent magnets 11, a torque is transmitted from the drive shaft to the impeller head 2 in a contactless manner.

The lower surface 12 has milled grooves 13 and is formed as a pump so that during the rotation of the impeller head 2, it provides a pumping effect.

FIG. 2 shows a horizontal section of the impeller head in accordance with line II—II. The parts of the container are here removed for the sake of clarity of illustration. The interrupted lines identify the grooves 13. Due to the arrangement of the grooves 13 which is similar to the vane wheel, during rotation of the impeller 2 in the direction of the arrow 14, a pumping effect is produced. It produces a flow which is outwardly directed from the hollow chamber 15 of the impeller head 2 as identified by arrow 16. The liquid aspirated from the central hollow chamber flows through a conduit 17 which connects the hollow chamber 15 with the surface of the impeller head 2. For dismounting of the impeller head 2, a lock 18 can be connected with a lifting device.

The outer surface 19 of the impeller head is conical. Therefore during the rotation of the impeller head, a downwardly directed axial force is produced due to the stirring forces. During operation in the direction of the arrow 14, the lower surface 12 of the impeller head 2 formed as a pump rotor produces a negative pressure in the hollow chamber 15. It causes an additional axial force which is also directed downwardly.

When the impeller head 2 is driven, however, in a direction opposite to the arrow 14, a flow is formed through the hollow chamber 15 opposite to the arrow 16. A positive pressure is produced in the hollow chamber 15. It causes an axial force onto the impeller 2 which is opposite to the axial force component of the stirring force. In this way, the axial forces are partially compensated.

Figure 4:
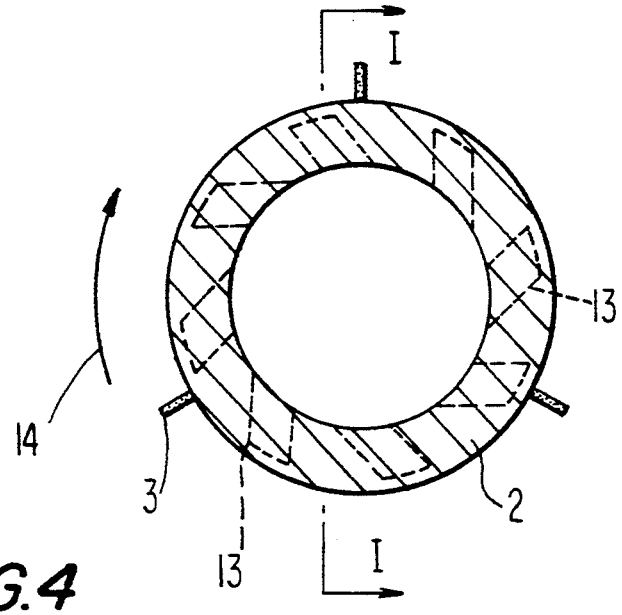

FIG. 3 shows a plan view of the impeller head which rotates in a clockwise direction in correspondence with the arrow 14. FIG. 4 illustrates the position of the grooves 13 on the lower surface of the impeller head 2. The connecting conduit 17 opens into openings 21 on the outer surface of the impeller head. The rotary direction in accordance with the arrow 14 produces on the lower surface of the impeller head an outwardly directed flow in correspondence with the arrow 16. This flow approaches the flow occurring in the opening 21 in correspondence with the arrow 20. For supporting the pumping action, the openings 21 are arranged in the rotary direction before the stirring plates 3, so that they are located at the pressure side of the stirring plates.

Figure 5:
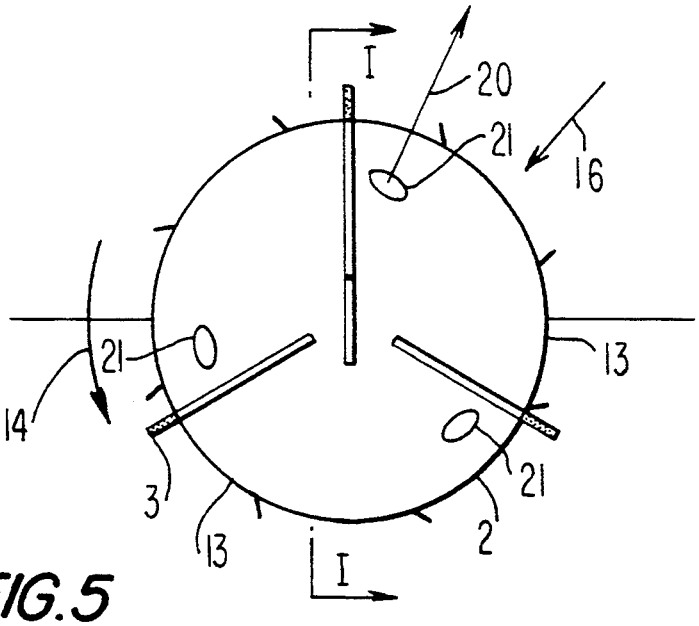
FIGS. 5 and 6 are views showing flow directions during driving in a counter-clockwise direction.
Figure 6:
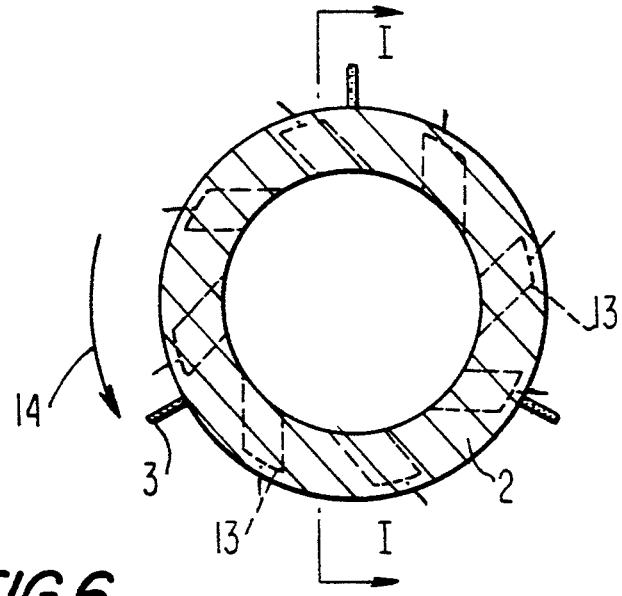

FIGS. 5 and 6 show the flow conditions for an opposite rotary direction. In the lower surface of the impeller 2, the flow is formed in accordance with the arrow 16 and produces a positive pressure in the interior of the hollow chamber. For supporting the spring action, the openings 21 are arranged behind the stirring plates 3, so that they are located at the negative pressure side of the stirring plates 3. The flow exits from the opening 21 in accordance with the arrow 21. The Figures do not show a support on slightly conical surfaces. It is, however, clear for a person skilled in the art that for the conical support surfaces between the pin 6 and the impeller head 2, a gap is produced which, depending on the axial position of the impeller head forms different flow cross-sections in the hollow chamber 15. In dependence on these cross-sections, in the hollow chamber 15, a corresponding positive pressure is formed which holds the gap automatically in an equilibrium position.

The pumping effect remains substantially independent from the filling height inside the container.

It will be understood that each of the elements described above, or two or more together, may also find a useful application in other types of constructions differing from the types described above.

While the invention has been illustrated and described as embodied in an impeller for stirring sterile liquids, it is not intended to be limited to the details shown, since various modifications and structural changes may be made without departing in any way from the spirit of the present invention.

without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An impeller for stirring sterile liquids, comprising a plurality of stirring plates; an impeller head supporting said stirring plates and having a substantially vertical rotary axis, an outer surface, a central hollow chamber with an opening, and a conduit connecting said central hollow chamber with said outer surface; means for driving said impeller head about said rotary axis and including a pin received in said opening, said impeller head having a lower region provided with a plurality of grooves which during rotation of said impeller head provide an effect of pumping a liquid.

2. An impeller as defined in claim 1, wherein said driving means are contactless inductive driving means.

3. An impeller as defined in claim 1, wherein said driving means are contactless magnetic driving means.

4. An impeller as defined in claim 1, wherein said driving means is formed so as to rotate said impeller head in a direction such as to form a positive pressure in said central hollow chamber.

5. An impeller as defined in claim 1, wherein at least a part of said central hollow chamber is conical.

6. An impeller as defined in claim 5, wherein at least a part of said pin has a conical surface.

7. An impeller as defined in claim 1, wherein at least a part of said pin has a conical surface.

8. An impeller as defined in claim 1, wherein said conduit is open in a region of said rotary axis.

9. An impeller as defined in claim 1, wherein said impeller head rotates in a predetermined rotary direction, said conduit being open behind said stirring plates as considered in said rotary direction.

10. An impeller as defined in claim 1, wherein said impeller head rotates in a predetermined rotary direction and has a plurality of such conduits, said conduits being open behind said stirring plates as considered in said rotary direction.

11. An impeller as defined in claim 1, wherein said driving means is formed so that a negative pressure is produced in said central hollow chamber.

12. An impeller as defined in claim 1, wherein said impeller head rotates in a predetermined rotary direction, said conduit being open before said stirring plates as considered in said rotary direction.

13. An impeller as defined in claim 1, wherein said impeller head rotates in a predetermined rotary direction and has a plurality of such conduits, said conduits being open before said stirring plates as considered in said rotary direction.

* * * * *